US008581793B2

(12) United States Patent
Carr

(10) Patent No.: US 8,581,793 B2
(45) Date of Patent: Nov. 12, 2013

(54) RFID ANTENNA WITH ASYMMETRICAL STRUCTURE AND METHOD OF MAKING SAME

(76) Inventor: William N. Carr, Montclair, NJ (US)

( * ) Notice: Subject to any disclaimer, the term of this patent is extended or adjusted under 35 U.S.C. 154(b) by 109 days.

(21) Appl. No.: 13/199,919

(22) Filed: Sep. 14, 2011

(65) Prior Publication Data

US 2013/0050047 A1 Feb. 28, 2013

Related U.S. Application Data

(63) Continuation-in-part of application No. 12/621,451, filed on Nov. 18, 2009, now Pat. No. 8,384,599, and a continuation-in-part of application No. 12/706,660, filed on Feb. 16, 2010, now Pat. No. 8,477,079, and a continuation-in-part of application No. 12/462,428, filed on Aug. 5, 2009, now abandoned.

(60) Provisional application No. 61/575,541, filed on Aug. 24, 2011.

(51) Int. Cl.
*H01Q 9/00* (2006.01)

(52) U.S. Cl.
USPC ..... 343/749; 343/822; 343/860

(58) Field of Classification Search
USPC ..... 343/749, 750, 820, 822, 850, 860
See application file for complete search history.

(56) References Cited

U.S. PATENT DOCUMENTS

| | | | | |
|---|---|---|---|---|
| 2,209,813 | A * | 7/1940 | Dow | 343/825 |
| 2,323,076 | A * | 6/1943 | Erich | 324/645 |
| 2,545,544 | A * | 3/1951 | Doherty | 333/32 |
| 2,583,773 | A * | 1/1952 | Hiehle | 333/4 |
| 5,600,335 | A * | 2/1997 | Abramo | 343/749 |
| 2003/0103011 | A1 * | 6/2003 | Rogers et al. | 343/749 |

* cited by examiner

*Primary Examiner* — Tho G Phan
(74) *Attorney, Agent, or Firm* — Kaplan Breyer Schwarz & Ottesen LLP

(57) ABSTRACT

An RFID antenna comprised of a first arm, load element, and second arm together providing a complex impedance match to one or more load circuits contained within the load element for operation at one or more frequency bands. The load element is comprised of one or more load circuits. Load circuits are further comprised of one or more RFID transponders, energy scavengers, microcontrollers, and associated sensor circuits. The first and second arms are different in length and shape resulting in an asymmetrical antenna structure along the major axis. The first arm, the load element, and the second arm all comprise radiative electromagnetic structures for ultra high frequency and higher bands of operation. Embodiments provide an antenna with Faraday coils located within the arms operating in one or more of low frequency and, high frequency bands.

12 Claims, 15 Drawing Sheets

RFID ANTENNA WITH ASYMMETRICAL STRUCTURE AND METHOD OF MAKING SAME

RELATED APPLICATIONS

This application is a continuation in part of the following US nonprovisional patent applications:

U.S. 2010 0068987 with a filing date of Aug. 5, 2009,

U.S. 2010 0066636 with a filing date of Nov. 18, 2009,

U.S. 2010 0207840 with a filing date of Feb. 16, 2010,

Priority is claimed from US provisional application 61 575541 with a filing date of Aug. 24, 2011. These four applications are hereby incorporated by reference in their entirety.

FIELD OF THE INVENTION

This invention concerns Radio Frequency IDentification RFID antennas to form electromagnetic devices used in the tagging, tracking, data logging and sensing of assets, manufactured goods, the environment and so forth.

BACKGROUND OF THE INVENTION

During recent years semiconductor transponders and various sensor technologies including microelectromechanical systems MEMS have developed to a level that permits low cost components operating with micropower. These developments when incorporated into this device and antenna comprise RFID tag circuits with embodiments configured for a variety of RFID fully passive, semipassive, and active tag applications. These developments have created a need for RF antennas with more desirable operational metrics for efficiency, bandwidth, physical footprint, multiband characteristics, versatility, multiuse, and cost of ownership. The present invention describes a miniature structure that configured into an antenna provides high efficiency, small footprint, multiband operation, and can be economically manufactured. The device and antenna described in this invention is comprises structures for low frequency LF, high frequency HF, and ultra high frequency UHF operation. Antennas described in this disclosure which include an integral RF-to-DC power supply are commonly referred to as "rectenna" devices.

SUMMARY

The present invention is a device and antenna comprised of a first arm, load element, and second arm together providing a complex impedance match to one or more load circuits contained within the load element for operation at one or more frequency bands. The first and second arms are different in length and shape resulting in an asymmetrical antenna structure along the major axis. The first arm, the load element, and the second arm all contains radiative structures for the frequency bands of operation. The load element is comprised of one or more load circuits. Load circuits are further comprised of one or more RFID transponders, energy scavengers, microcontrollers, and associated sensor circuits in different embodiments. Embodiments provide an antenna operating in one or more of low frequency, high frequency, and ultra high frequency bands.

Figure 1:
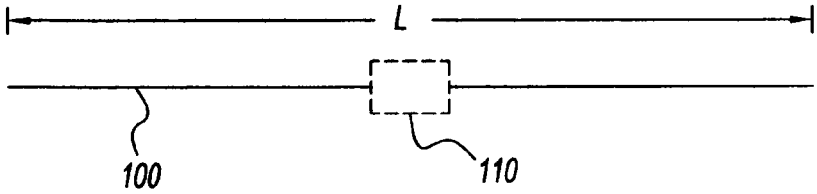
Fig. 1 (Prior Art)
Figure 2:
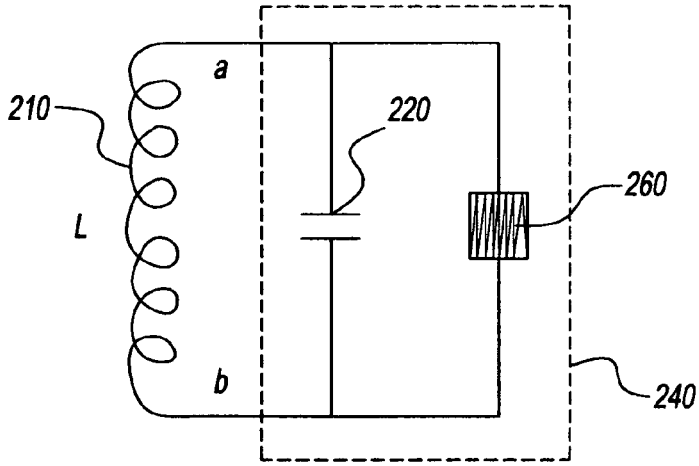
Fig. 2 (Prior Art)

FIG. 1 shows a prior art far field, symmetrical dipole antenna which operates at its self-resonant frequency providing a resistive impedance to its load. The present invention is comprised of an asymmetrical structure and couples into complex impedance load circuits differing from the prior art. The prior art dipole antenna has arm 100 and a load 110. FIG. 2 shows a prior art Faraday coil which provides a voltage source when positioned in a changing magnetic field. The coil is directly connected into a load element 240 which contains a load circuit 260 and often a capacitor 220 resonating with the inductance of coil 210. The present invention in embodiments is comprised of both r far field electromagnetic and near field Faraday coils in which the Faraday coils serve as one or more arms of the UHF antenna.

In multiband embodiments the planer Faraday coils in the first and second arms provide signal pickup at low frequency LF and high frequency HF bands. These same coils act as conductive sheets in the ultra high frequency UHF band. Because of the close spacing of the coil turns each Faraday coil serves a dual purpose as an arm of the UHF antenna and also as a Faraday pickup coil for RF magnetic field induction in LF and HF bands.

In embodiments the load circuit comprises one or more of functions for scavenging power from sources including incident RF fields, thermoelectric temperature differential, solar cells, and batteries. Also in embodiments the load circuit comprises one or more of functions for receiving and decoding wireless data from incident RF fields, backscatter modulation of the incident RF fields, and transducer functions such as measurement of temperature, humidity, vibration, fluid flow, corrosion, pressure, presence of gas or chemicals, power consumption, light, flames, and display of information.

The conductive films in the structure of this antenna cover a dielectric substrate comprised of polyethelene terephthalate PET, polycarbonate, polybutylene terephthalate PBT, Duroid, polyphenylene sulfide PPS, polysulfone, polyetherimide, polyester sulfone PES, polyimide, polyester aramid polyamideimide PAI, nylon, Teflon, polyetherimide, polyvinylchloride, acrylonitrile butadiene styrene ABS, glass and other materials including paper. In embodiments the substrate may be rigid or flexible.

The antenna is comprised of patterned conductive films including aluminum, copper, silver, gold, and nanotubes patterned by means of but not limited to lithography etching, inkjet printing, selective electroplating, stamping, laser ablation, and focused ion beam deposition.

The antenna functions as an RFID tag when configured with fully passive, semipassive, or active load circuits. As a fully passive RFID tag the antenna is configured to operate only with power scavenged from an external RF power source. A fully-passive RFID load circuit is powered from incident RF electromagnetic energy received usually from an external RF beacon or reader device. As a semipassive RFID tag the antenna is configured to operate with a combination of one or more power sources including a local battery, a piezoelectric transducer, a thermoelectric transducer, and scavenged power from incident RF. The fully passive and semipassive configurations receive information (downstream) via modulated incident RF fields or waves from a nearby reader.

Fully passive RFID embodiments communicate back (upstream) to an external reader by modulating the backscattering of an incident RF field or wave. In semipassive RFID embodiments the tag may communicate upstream to an external reader by modulating backscattered RF, transmitting an active RF signal, or both. In the active tag embodiment the load circuit actively transmits RF power to an external reader. All RFID tag embodiments contain a radio receiver for decoding commands and data from an external reader. These three tag types are well known to those skilled in the art.

The load circuit within the load element determines whether the antenna operates as a fully-passive, semipassive, active RFID antenna, or as a radio-controlled circuit without communication back to an external reader. In different embodiments the load circuit contained within the load element is comprised of integrated and discrete components to provide specific tag functions In embodiments the load circuit is comprised variously of an RF-to-DC converter circuit typically a Schottky or a MOS diode voltage multiplier providing DC power for an LCD display, or other passive transducer devices with control data provided by demodulating the incident RF carrier energy from a beacon or reader source.

During recent years semiconductor transponders and various sensor technologies including microelectromechanical systems MEMS have developed to a level providing low cost components operating with micropower. These developments when incorporated into RFID tag circuits have made a variety of RFID tag applications possible. These developments have created a need for RF antennas that improve the operational metrics for efficiency, bandwidth, footprint, multiband characteristics, and cost of ownership.

In the present invention, the antenna provides operation with a load circuit which is within the load element. All embodiments of this invention are comprised of UHF rectennas designed for operation in the far field electromagnetic range with an external RF power source. The overall length of the antenna is less than a half-wavelength (referred to free space). A complex impedance to be presented to the load element for the UHF wavelength of interest from the first and second arms of the antenna. Since the load element is a significant portion of the total length of the antenna the load element supports electric and magnetic fields at UHF which distribute the radiative surface over the entire length of the antenna.

We define a major structural axis along the length of the antenna with arms at each end. The arms of the antenna may be configured into various shapes. In embodiments the arms can be rectangular. In other embodiments the plates may be variously shaped to influence operating frequency, bandwidth, UHF electromagnetic polarization, and overall radiation efficiency for the RFID antenna.

In embodiments the substrate is comprised of an adhesive label, Velcro-like surfaces, or other material facilitating placement and positioning of the substrate in specific applications.

Typical matching networks within the load element for the UHF antenna function include the well known T-match network. Other networks are familiar to those skilled in the art. The matching networks used in different implementations are passive coupled inductors and capacitors.

The RFID tag radiation pattern is affected by nearby metal structures and surfaces. A parallel conductive ground plane can be used to enhance UHF reflection from antenna and thus provide gain in a direction normal to and away from the ground plane The ground plane may be external or it may be included within the same enclosure with the arms and load element.

The RFID antenna in this invention is distinguished from other antennas in its asymmetry along the major axis, inclusion of RF complex impedance matching structures into its load element, and fully distributed electromagnetic fields for the UHF antenna function. Magnetic field induction coupling to integral Faraday coils for low frequency LF and high frequency HF together with the UHF antenna function comprise a multiband antenna.

LIST OF FIGURES

FIG. 1 Farfield electromagnetic dipole antenna (prior art).

FIG. 2 Faraday induction antenna (prior art).

Figure 3:
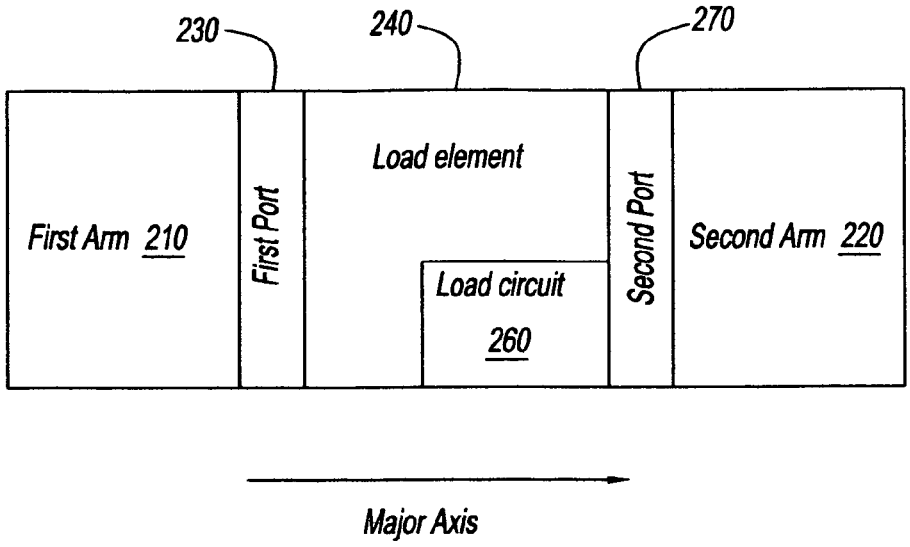

FIG. 3 Structural components of the present invention.

Figure 4A:
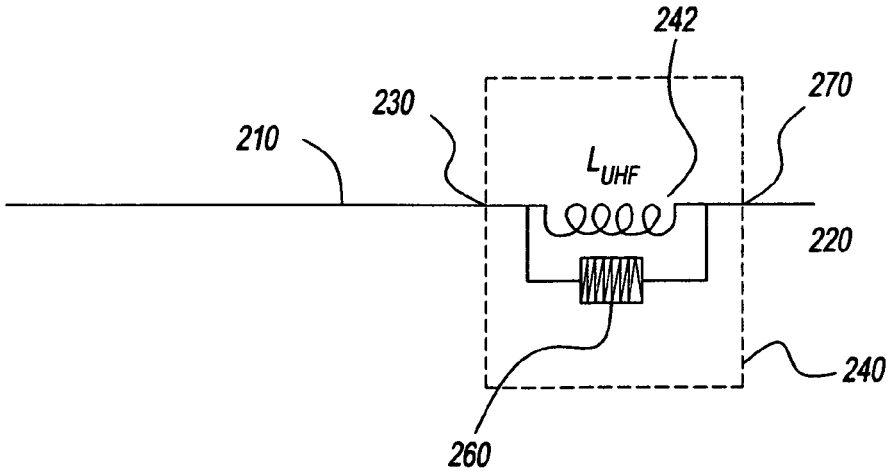
Figure 4B:
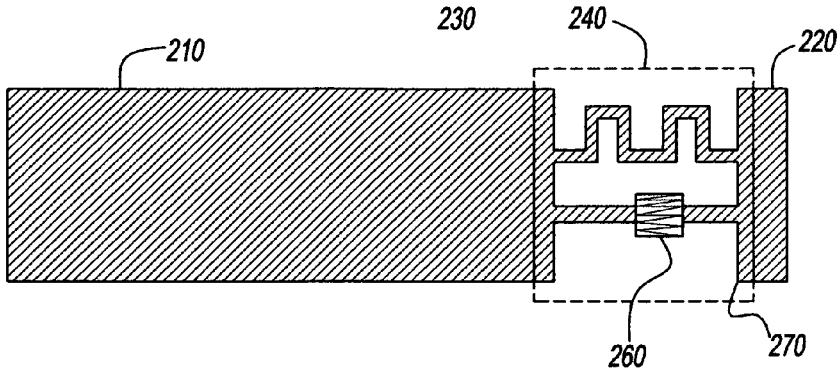

FIG. 4 UHF antenna structure (a) schematic of the lumped circuit equivalent component, (b) top view antenna with UHF function only.

Figure 5A:
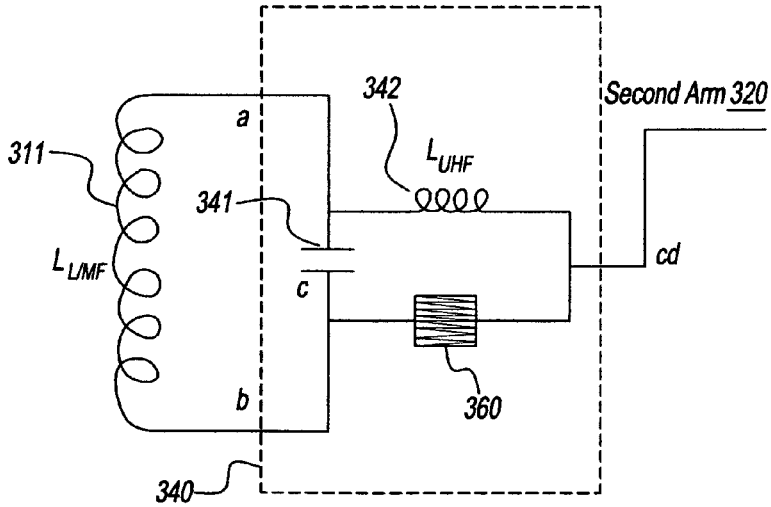
Figure 5B:
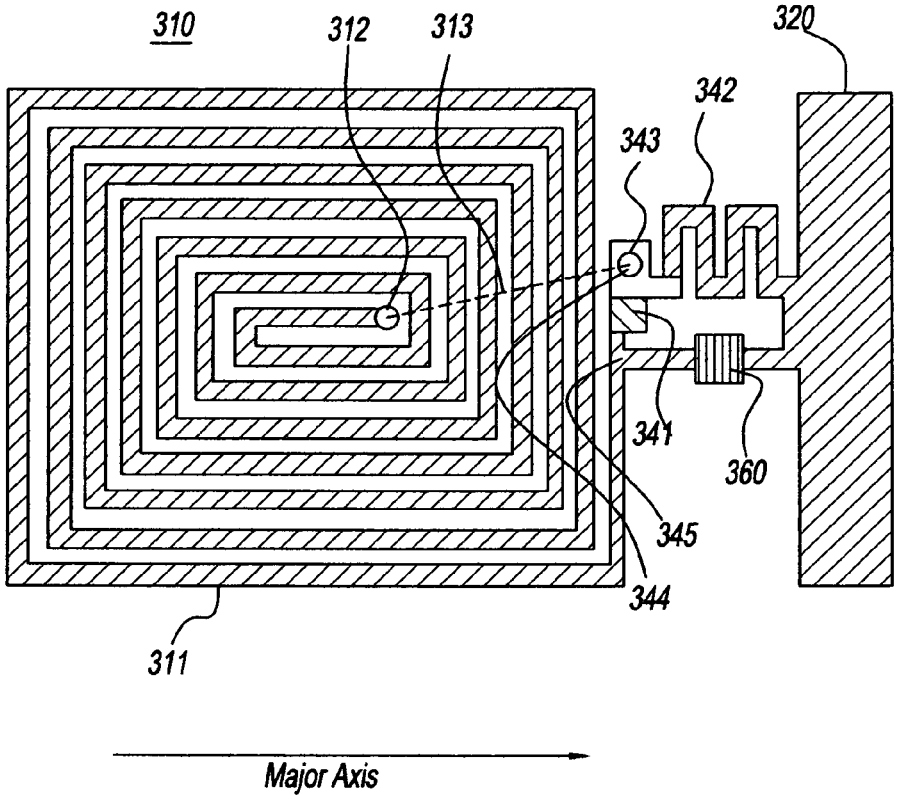

FIG. 5 Antenna configured for dual band operation with a single load circuit for UHF and either LF or HF operation, (a) lumped equivalent circuit, (b) top view showing patterned Faraday coil and other components.

Figure 6A:
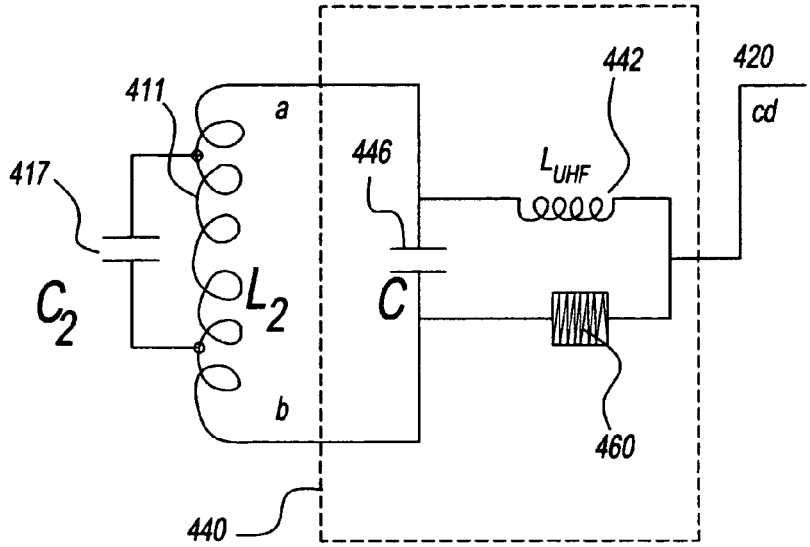
Figure 6B:
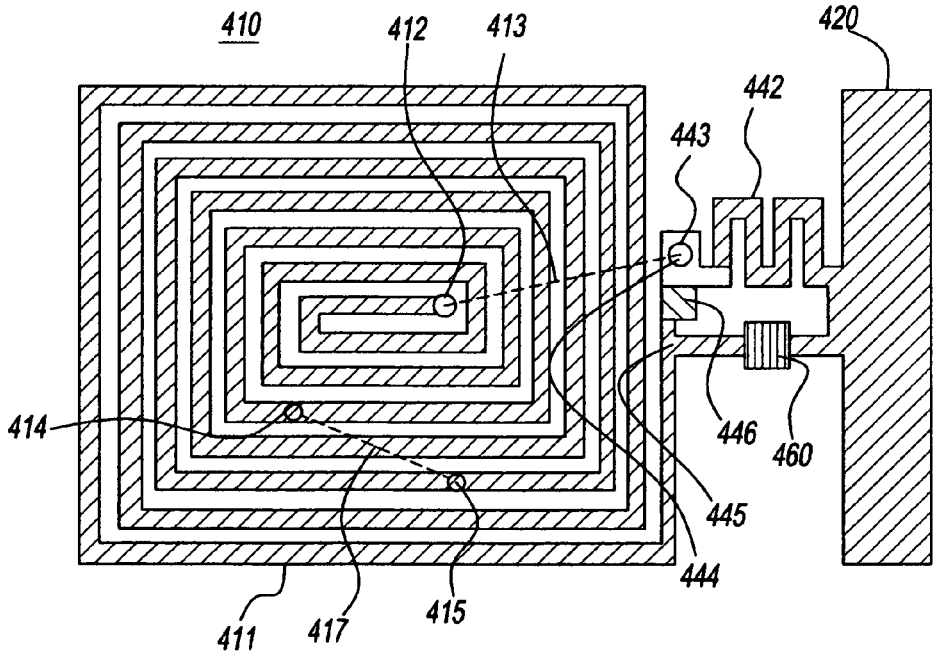

FIG. 6 Antenna configured for triband operation with a single load circuit for UHF and a shared Faraday coil for LF and HF with bypass capacitance C2, (a) lumped equivalent circuit, (b) top view showing patterned conductor and components.

Figure 7A:
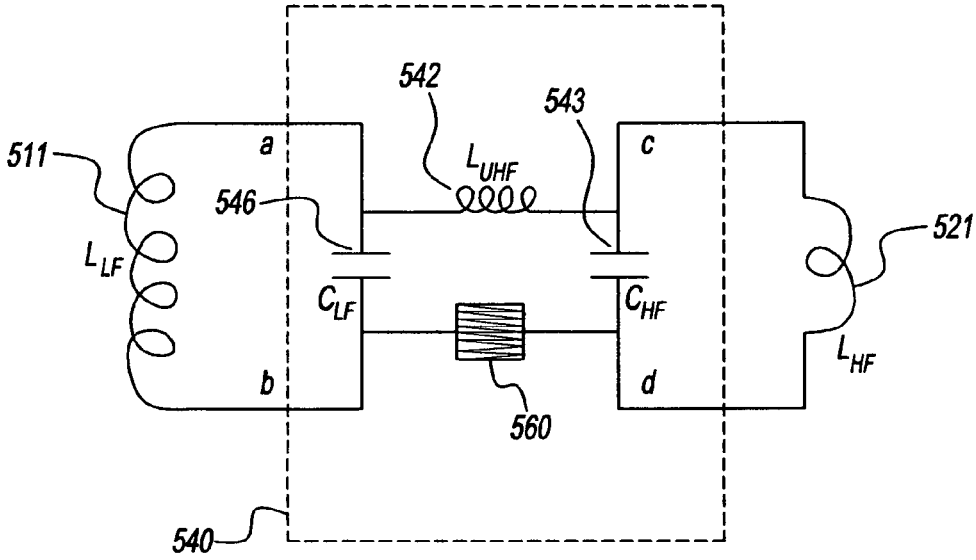
Figure 7B:
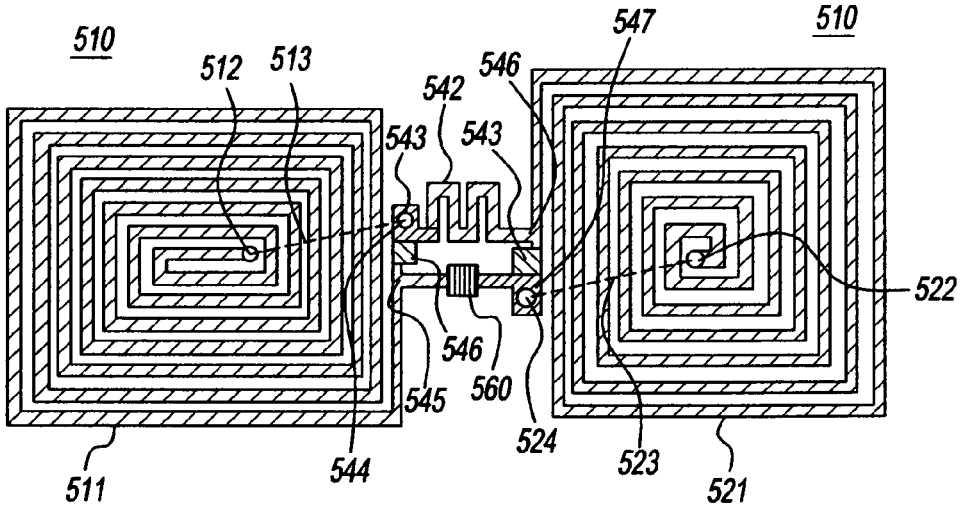

FIG. 7 Antenna configured for triband operation with a single load circuit for UHF with separate Faraday coils for LF and HF, (a) lumped equivalent circuit, (b) top view showing patterned Faraday coils and components.

Figure 8A:
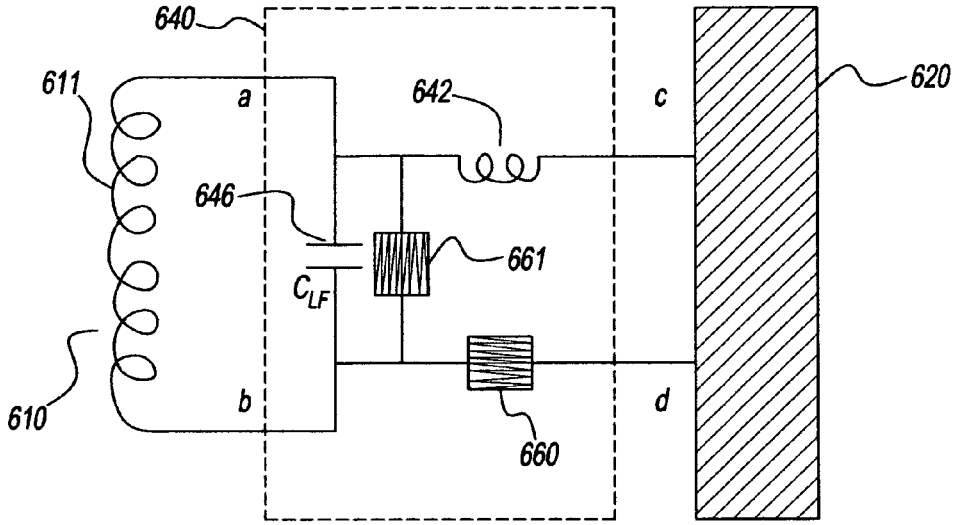
Figure 8B:
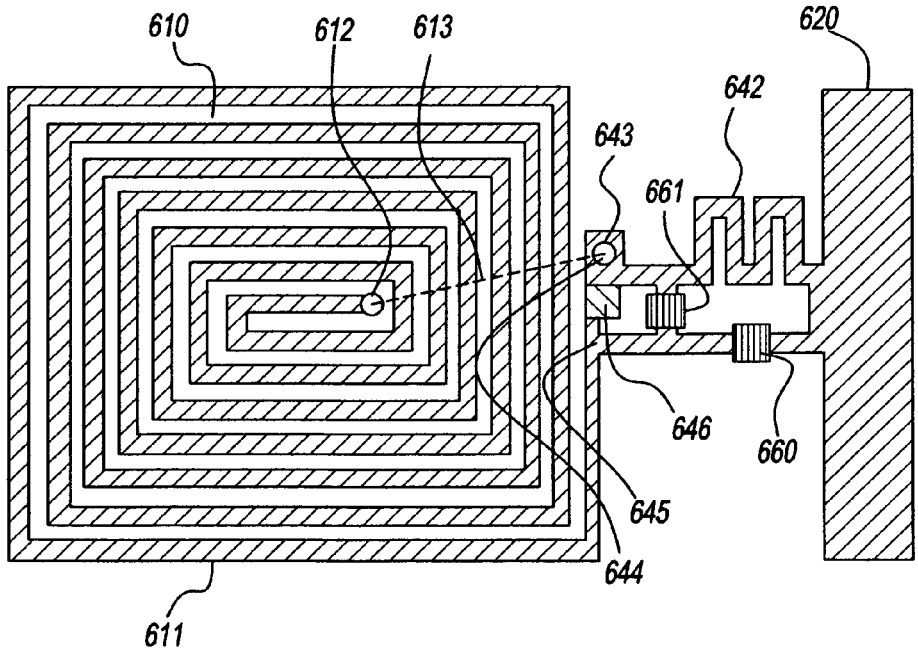

FIG. 8 Antenna configured for dual band operation with dedicated load circuits for each band, (b) top view showing patterned Faraday coil and components.

Figure 9:
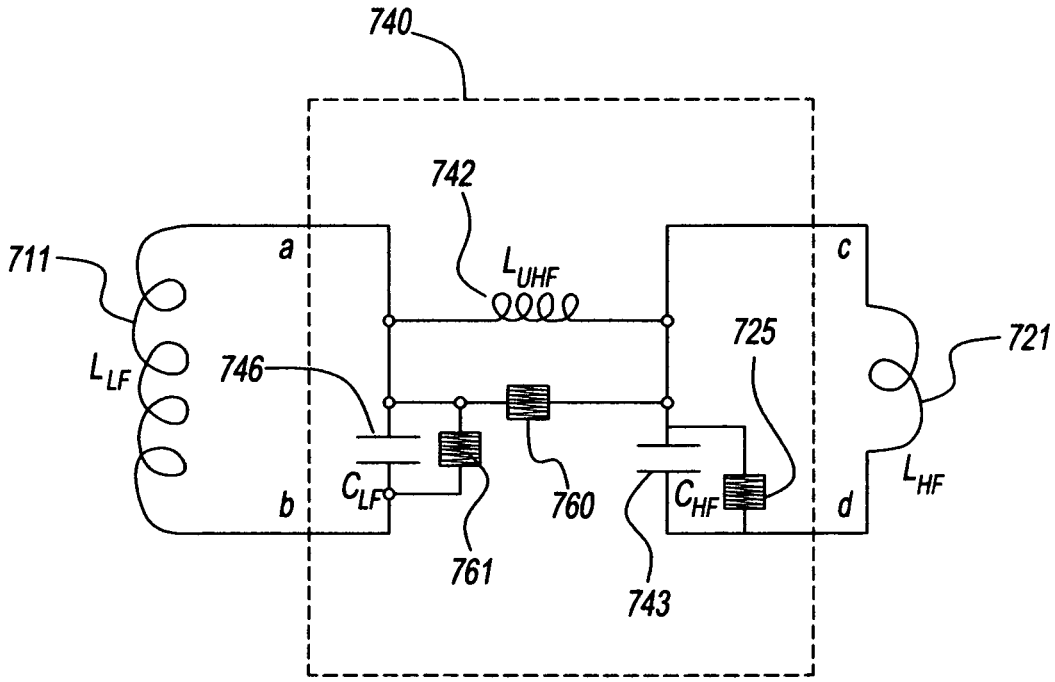

FIG. 9 Antenna configured for triband operation with dedicated load circuits for each band showing the lumped equivalent circuit.

Figure 10:
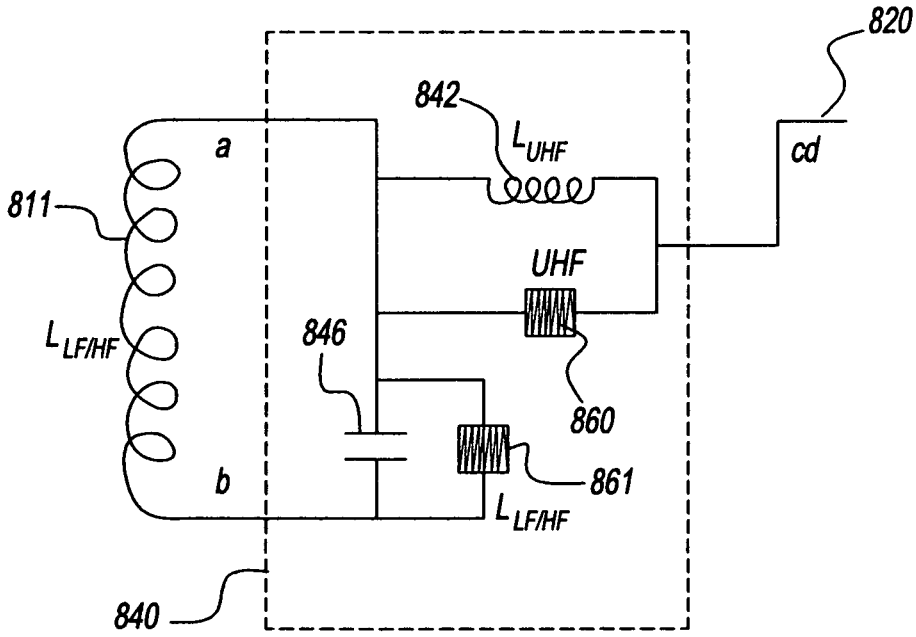

FIG. 10 Antenna configured for dual band operation with dedicated load circuits for UHF and LF of HF showing the lumped equivalent circuit.

Figure 11:
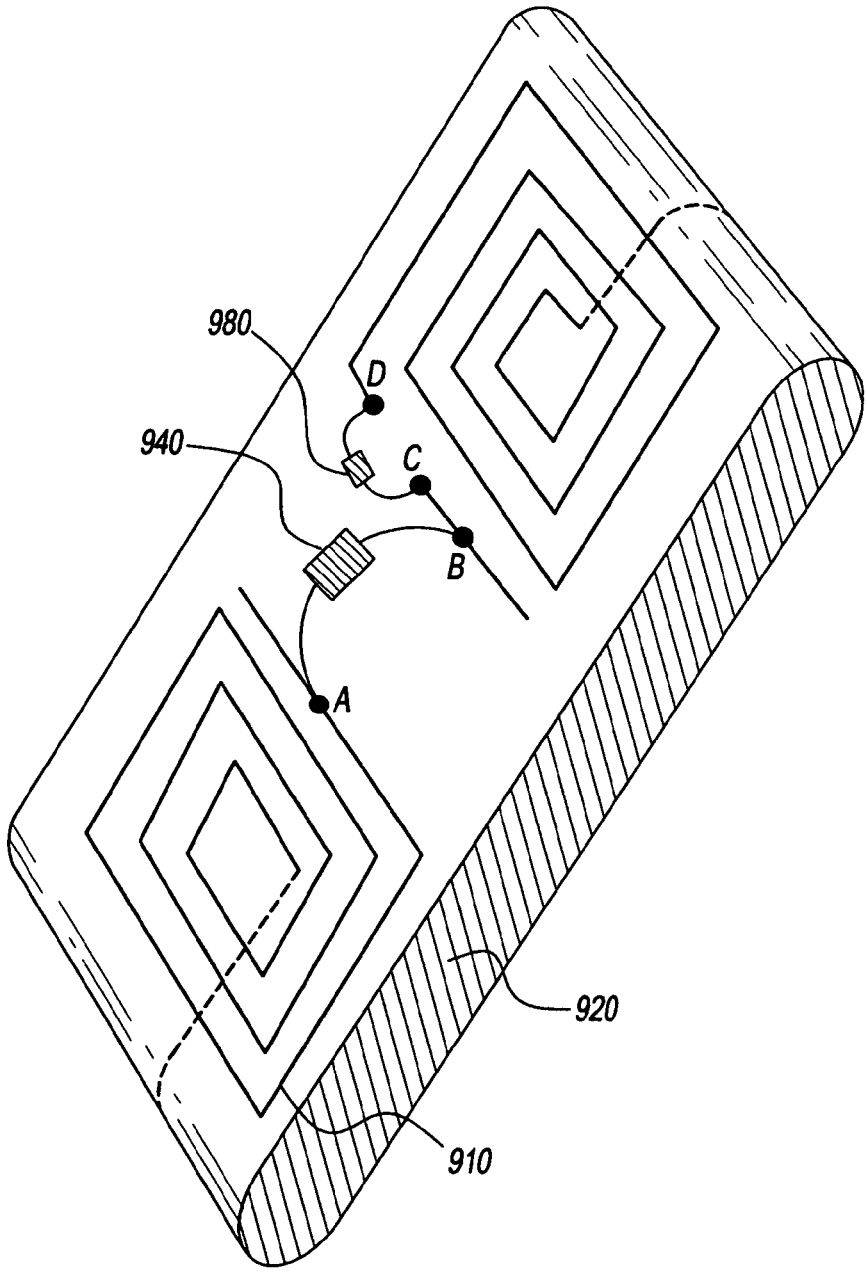

FIG. 11 Antenna with two layers of patterned Faraday coils configured for dual band operation with separate UHF and LF load circuits and a LF Faraday coil wrapped around both ends. Separate load circuits for LF/HF and UHF.

Figure 12:
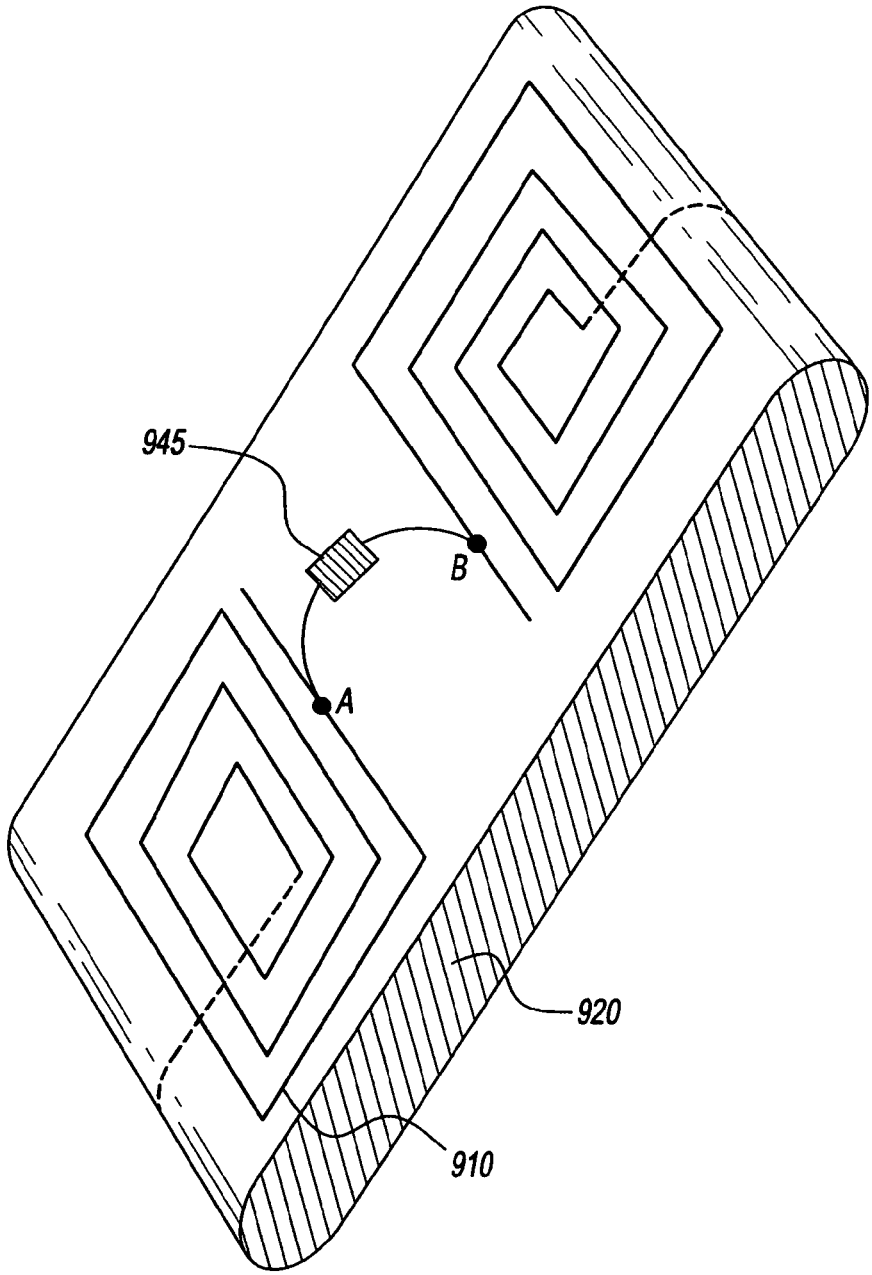

FIG. 12 Antenna with two layers of patterned Faraday coils configured for dual band operation with separate UHF and LF load circuits and a LF Faraday coil wrapped around both ends. LF/HF and UHF load circuits are combined together. Faraday coil wrapped around both ends.

Figure 13:
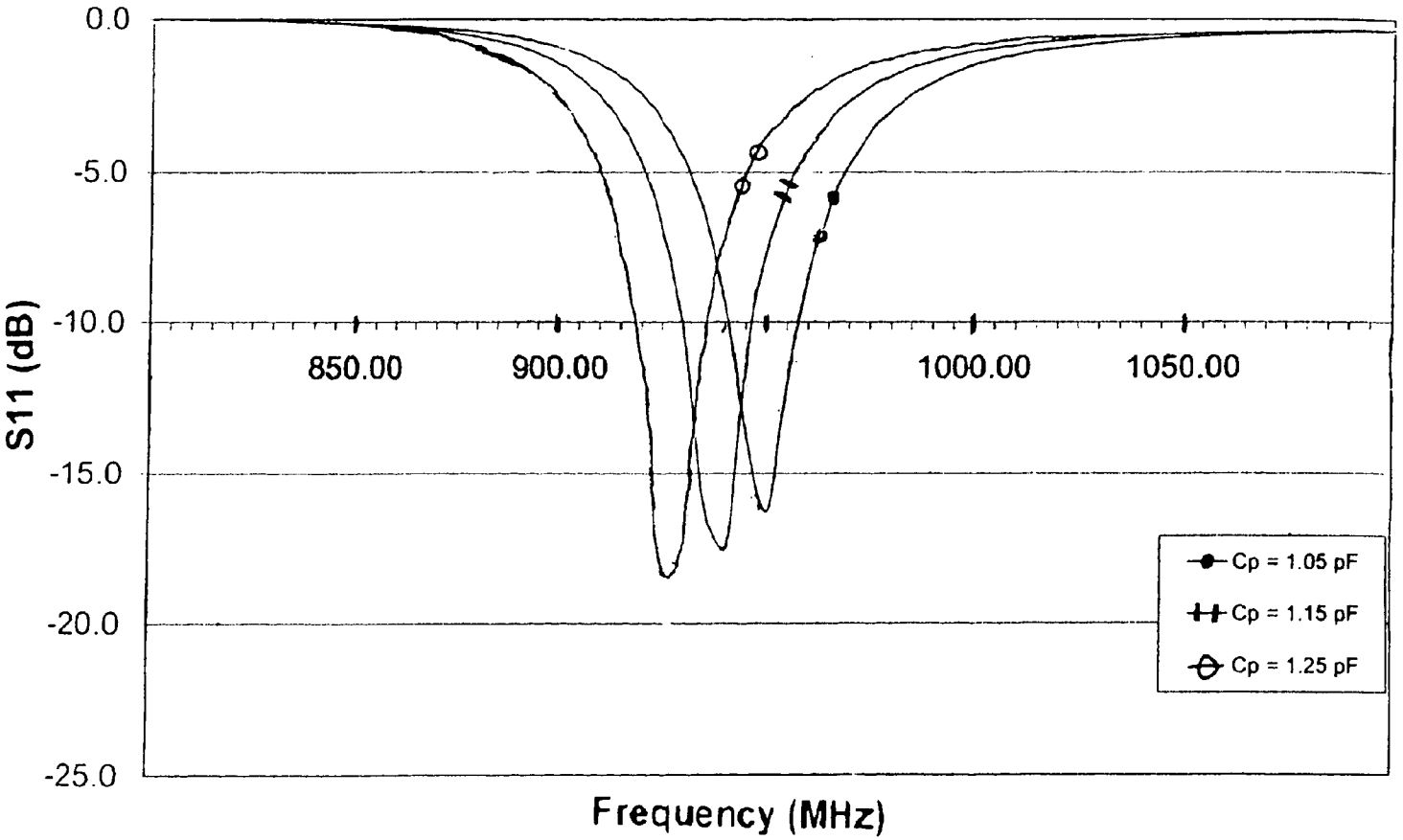

FIG. 13 Performance of the antenna power efficiency coupling within the load element between the first and second arms and a specific UHF load circuit.

Figure 14:
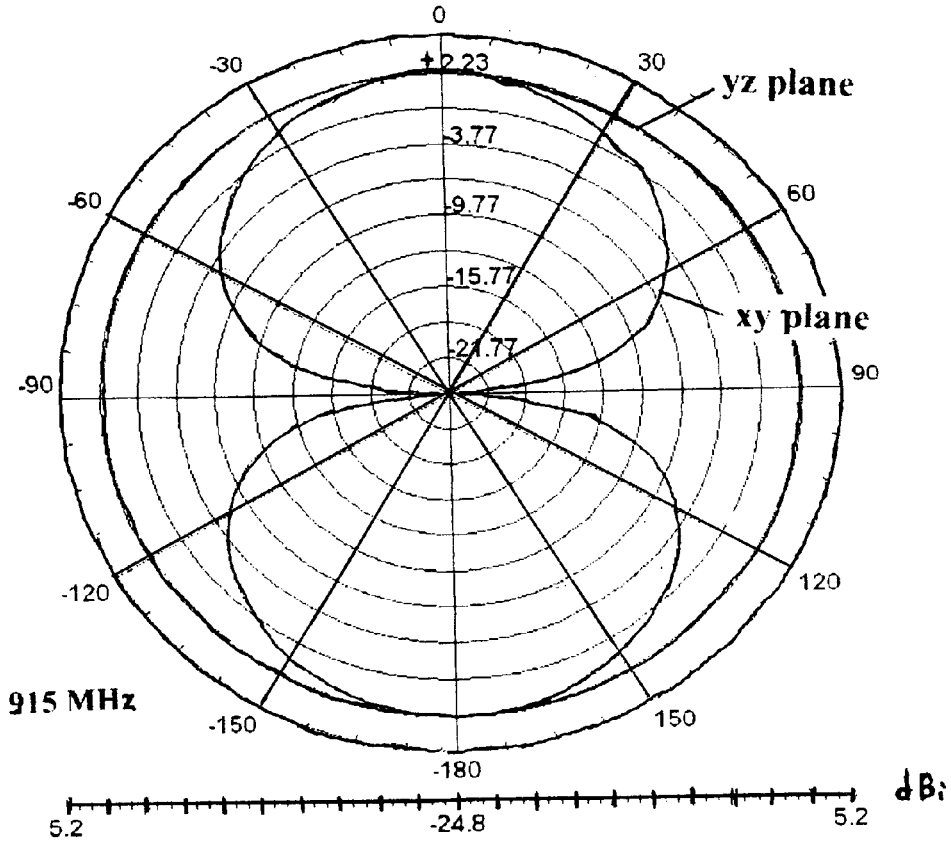
Figure 15A:
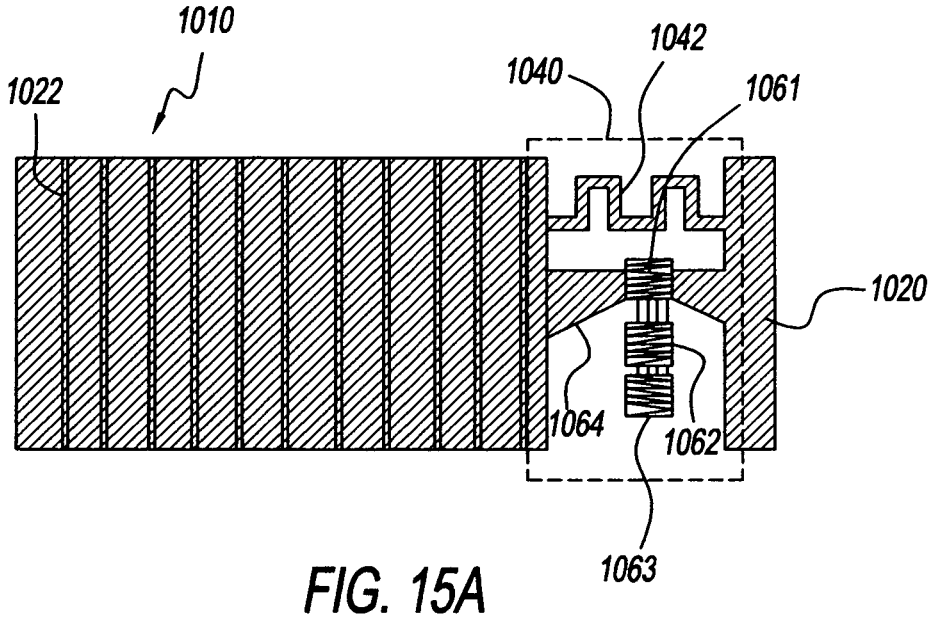
Figure 15B:
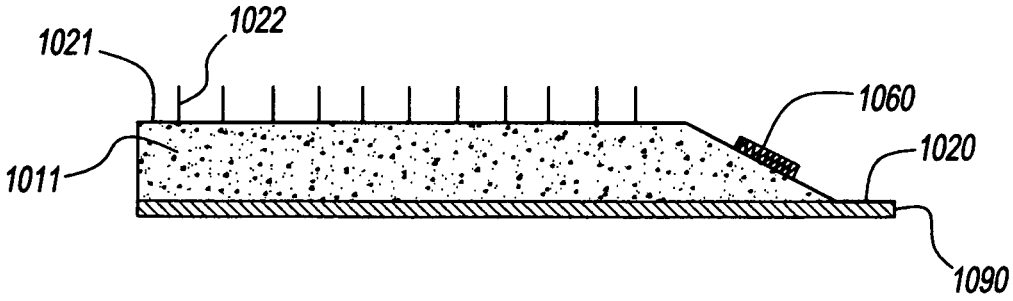
Figure 15C:
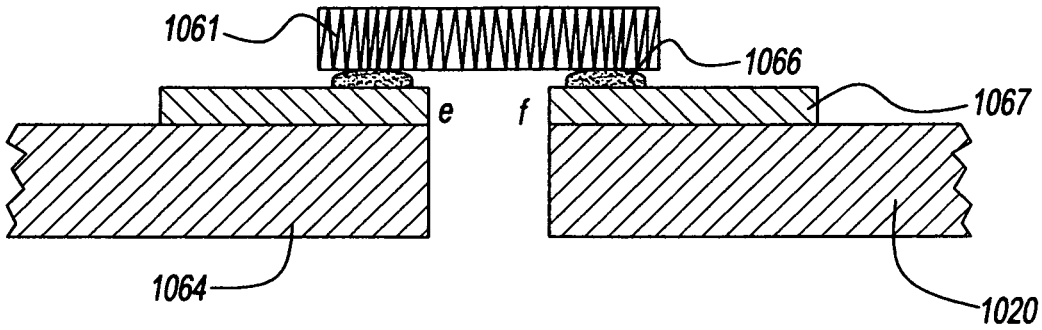
Figure 15D:
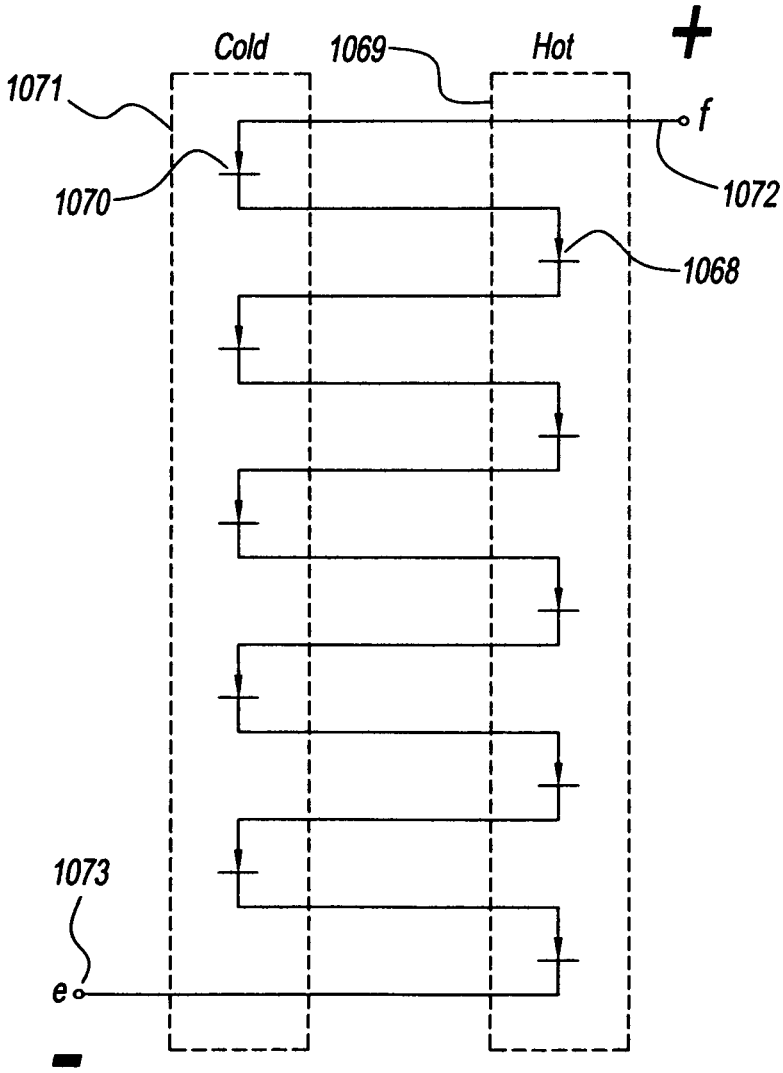

FIG. 14 Far field radiation pattern of the antenna of FIG. 13 at UHF 915 MHz.

FIG. 15 Antenna configured with a thermoelectric load circuit for scavenging energy from a temperature differential (a) top view, (b) side view cross-section, (c) close-up cross section of the thermoelectric device, and (d) circuit schematic with semiconductor thermocouple in a thermopile connection.

DETAIL DESCRIPTION

The RFID antenna structure of the present invention is asymmetrical along the major axis and with multiband embodiments in which a first arm 210 is connected to a first port 230 of a load element 240 arranged in the architecture of FIGS. 3 and 4. A representative schematic architecture generalizing the embodiments in this invention is provided in FIG. 3. FIG. 4(*a*) shows the lumped equivalent of the FIG. 3 architecture, and FIG. 4(*b*) shows a top view schematic of the UHF antenna structure. A second arm 220 is connected to a second port 270 of the load element 240. The load element comprised of an impedance matching network 242 and a load circuit 260 is connected between two asymmetric patterned conductors to form the entirety of the antenna structure. The antenna structure has embodiments providing operation for a single UHF band and also for multiband operation including LF, HF, and UHF. The UHF frequency band of operation is determined from an interaction of all structures along the length of the antenna including the impedance matching network and the physical structures. When configured for LF and HF operation one or more arms contain a Faraday coil that provides a voltage drive for the load element from a varying magnetic induction field. Both arms also serve a second purpose as integral components of the UHF antenna structure. For UHF operation the load element matches the complex impedance from the patterned conductive films into the load circuit shifting the operating frequency of the antenna structure away from the self resonance frequency of basic dipole structure that includes the first and second arms.

In the description of this invention numerous specific details are given to provide an understanding of embodiments. One skilled in the relevant art will recognize however that the embodiments can be practiced without one or more of the specific details, or with other methods, components, materials, etc. In other instances, well-known structures, materials, or operations associated with antennas are not shown or described in detail to avoid obscuring key aspects of the embodiments.

Unless the context requires otherwise, throughout the specification and claims which follow, the word "comprise" and variations thereof, such as, "comprises" and "comprising" are to be construed in an open, inclusive sense "including but not limited to". Reference through this specification to "one embodiment" or "an embodiment" means that a particular feature, structure, or characteristic described in connection with the embodiment is included in at least one embodiment. Thus, the appearances of phrases "in one embodiment" or "in an embodiment" in various places throughout this specification are not necessarily all referring to the same embodiment. Futhermore, the particular features, structures, or characteristics may be combined in any suitable manner in one or more embodiments.

Reference through this specification and claims to "radio frequency" or RF includes wireless transmission of electromagnetic energy including but not limited to energy with frequencies or wavelengths typically classed as falling into the low, high, ultrahigh, superhigh and above superhigh frequency portions of the electromagnetic spectrum.

Embodiment functions referred to as "UHF" include structures that can be scaled with appropriate fabrication technologies to include frequency bands ranging from 300 MHz up to as high as 3 THz. In this description embodiment functions referred to as LF cover the frequency range from 100 KHz up to 5 MHz. Functions referred to as HF cover the frequency range from 5 to 300 MHz. In embodiments providing operation in both LF and HF bands, the HF band is always designed to be at least a factor of 3× higher than the LF band.

An electromagnetic RFID antenna in this description is a device that is excited by the far field wave from an external RF transmitter and further provides RF power to the load element and are generally called far field devices. The structures in the UHF antenna function of this invention comprise a far field device.

An induction or Faraday RFID antenna in this description is a device that is excited by an RF magnetic field and further provides RF power to the load element based on the Faraday effect. Antennas exited by induction fields are generally called near field devices.

It is well known in the art that antennas are reciprocal devices, meaning that an antenna that is used as a transmitting antenna can also be used as a receiving antenna, and vice versa. There is a one-to-one correspondence between the behavior of an antenna used as a receiving antenna and the behavior of the same antenna used as a transmitting antenna. This property of antennas is known as "the principle of reciprocity". In this description the present invention antenna is described variously as operating in either or both a receiving and a transmitting mode. In various embodiments the LF, HF, and UHF components of this antenna are separately operated either as RF receivers or transmitters or both.

FIG. 5 is an embodiment of the antenna configured for dual band operation with a single load circuit which operates at UHF and either LF or HF operation. FIG. 5(*a*) is the lumped equivalent circuit and FIG. 5(*b*) is a top view showing structural components. The first arm 310 comprises a Faraday induction coil 311 on one surface of a dielectric film. One terminal of the induction coil is connected to the first port contact-a 344 through a backside interconnect 313 with vias 312 and 343. The other terminal of the induction coil is connected to the first port contact-b 345. The resulting induction voltage at the first port developed from an RF magnetic field drives the load element 340 comprised of the network element 342, a load circuit 360 and an optional first capacitor 341. The inductor342 within the load element has a very small reactance at LF or HF and has little effect on the operation of the antenna at frequencies below UHF. The capacitor 341 together with the Faraday induction coil 311 resonate at the frequency band of interest in either a LF or HF band and provide a voltage drive for the load circuit 360.

In FIG. 5(*b*) the UHF drive into the load element is provided by the RF signal created in the first 310 and second 320 arms and presented to the load element across the two antenna ports. The load element contains the impedance matching network with efficient RF coupling of power with the load circuit 360. The first capacitor 341 has a small reactance in the UHF band of operation and therefore appears in the impedance matching network as a near short circuit at UHF. Together both the UHF and lower frequency structures of FIG. 5 comprise a dual band antenna. The load circuit is designed to operate in the desired frequency bands at UHF and LF or HF.

The structure of FIG. 5(*b*) operates within a selected UHF band by designing the dimensions of the first arm 310, the second arm 320 and the load element appropriately. The load element impedance matching network 342 provides the desired source impedance into the load circuit 460 for the UHF band. The capacitance 341 is very low impedance at UHF providing what is essentially a short circuit at UHF within the load element. The LF or HF frequency RF voltage at contacts a 344 and b 345 is applied directly through the load element 342 to the load circuit 360 without attenuation because of the small inductive reactance of the signal path.

FIG. 6 presents an embodiment of the antenna configured for tri-band for UHF, LF, and HF operation and with a single load element. FIG. 6(*a*) is the lumped equivalent circuit and FIG. 6(*b*) is a top view showing the antenna structural components. The first arm comprises an induction coil 411 on one surface of a dielectric film. In FIG. 6 the LF induction coil 411 in the first arm 410 is directly connected to the first port terminal-a 444 and terminal-b 445. The bypass capacitor C2 417 has sufficiently high reactance at LF to not affect the Faraday voltage presented to the first port. One terminal of the induction coil 411 is connected to the first port contact-a at the interface to the load element 440. The conductive connection from the induction coil into contact-a is implemented through the interconnect 413 on the backside of a dielectric film and vias 412 and 443. The other terminal of the induction coil is connected to the first port contact-b 445. The first capacitor 446 in the load element is used for the HF antenna function and has sufficiently small reactance at LF to not appreciably affect the efficiency of antenna operation at LF. The structures as described complete the circuit supplying a LF induction signal to the load element 440 and provide a LF antenna function for the FIG. 6 embodiment.

The structure of FIG. 6(*b*) operates within a selected UHF band by designing the dimensions of the first arm 410, the second arm 420 and the load element appropriately. The load element impedance matching network 442 provides the desired source impedance into the load circuit 460 for the UHF band. The capacitance 446 is very low impedance at UHF providing what is essentially a short circuit at UHF.

FIGS. 6(*a*) and 6(*b*) show a lumped equivalent circuit and a top view of its implementation, respectively. This embodiment comprises a tri-band antenna with operation in the LF, HF, and UHF bands. One terminal of the Faraday coil is connected to terminal a 443 of the first port through the interconnect 413 and vias 412 and 444. For LF operation the induction voltage provided by the entire coil is supplied into the contacts 443 and 444 of the first port by selecting a capacitance structure for 417 which has a high reactance at LF.

To achieve HF operation for the antenna of FIG. 6 a portion of the coil 411 is bypassed by the capacitor and its interconnect 417 which is selected to provide a of low reactance at HF thereby effectively reducing the inductive impedance of coil 411 in the HF band of interest as presented to the first port terminals a 443 and b 445. In FIG. 6(*b*) capacitor and interconnect 417 achieves the bypass connection through the backside structure with vias 414 and 415. When a load circuit is used which operates over the entire range LF, HF, and UHF one obtains a tri-band antenna.

In FIG. 6 the UHF antenna function is provided similar as in the FIG. 5 antenna embodiment where the first arm 410 and second arm 420 are directly connected into the load element with its internal matching network 442 and into the load circuit 460. Thus, the antenna of FIG. 6 provides operation within a UHF band. This embodiment requires a load circuit that operates over the LF, HF, and UHF frequency range. All three substructures coupling into a single load circuit provide a tri-band antenna function with three frequency bands within LF, HF, and UHF ranges FIG. 7 presents an embodiment of the antenna configured for tri-band operation with a single load element 542 and two separate Faraday coils 511, 521 and two separate resonating capacitors 546, 543 to provide LF, and HF operation in addition to UHF. FIG. 7(*a*) is the lumped equivalent circuit and FIG. 7(*b*) is a top view showing the antenna structural components. The first arm 510 comprises an induction coil 511 for LF on one surface of a dielectric film within the first arm 510. One terminal of the induction coil 511 is connected through the first port contact-a 543 through the interconnect 513 and via 512, 543 combination into the load element 540. The other terminal of the induction coil 511 is connected to the first port contact-b 545 also at the interface to the load element 540. Thus the Faraday signal from varying magnetic fields is presented across the first port terminals into the load element. Capacitor CLF 546 in the load element forms a resonant tank circuit with the inductive reactance of the coil 511 increasing the signal level at the first port from LF magnetic fields. The amsll reactance of the signal path through 542 and 521 at LF applies the full voltage from first arm port a and b contacts into the load circuit 560. This structural component in FIG. 7 provides the desired LF band of operation.

In FIG. 7 the second arm 520 is comprised of Faraday coil 521 and its underlying dielectric film. The coil 521 connects into the second port at contact points c 547 and d 524. Capacitor 543 within the load element 540 forms a tank circuit with the coil 521 resonating at a desired HF band provides a signal across the second port into the load element which in turn provides a low impedance path at HF into the load circuit 560. One connection to coil 521 is made through interconnect 523 with vias 522 and 524 into a second port contact-b 547. The other end of coil 521 connects directly into the other contact-a 544 of the second port. The capacitor 546 in the LF tank circuit provides a low reactance and thus acts essentially as a short circuit within the load element to route the HF signal directly into the load circuit 560. These structures provide an antenna function within the desired HF band.

In addition the UHF antenna structure of FIG. 7 provides the UHF antenna function essentially in the same manner as in the embodiments of FIGS. 5 and 6. The UHF antenna function is provided from the first arm 510 and the second arm 520 excited by a far field electromagnetic wave and with coupling into the load element through the first and second ports, respectively. The matching network 542 within the load element 540 provides the desired UHF impedance match from the arms into the load circuit 560. The capacitive reactance of capacitors 543 and 546 is very small at UHF and matching network is designed with these two capacitors to provide an efficient impedance matching network within the load element 540 at UHF. The load circuit in this embodiment operates over the frequency range LF, HF, and UHF. Thus, the structures of the FIG. 7 embodiment comprise an antenna for tri-band operation with a single load circuit.

FIG. 8 describes an embodiment providing dual band operation in a UHF band and in either a LF or HF band using two dedicated load circuits. FIG. 8(*a*) shows the lumped equivalent model and FIG. 8(*b*) is a top view of the antenna structure. The Faraday coil 611 in the first arm 610 provides signal through the first port into the load element 640 with further connection into the load circuit 660. The coil 611 connection to first port contact-a 644 uses the backside interconnect 613 and vias 612 and 643 to provide one connection intothe load element 640. The other terminal of coil 611 is directly connected into first port contact-b 645. The load element 640 contains a capacitor CLF 646 across the first port to resonate with the coil 611 inductance and increase the Q of the Faraday circuit at LF or HF as selected. The signal from pickup coil 611 is connected into the load circuit 660 through the load element inductance 642. This structure provides an antenna function for LF or HF in the embodiment of FIG. 8

In FIG. 8 the UHF antenna function is obtained as in the other embodiments by the combined electromagnetic coupling of arm 610, arm 620, and the load element 640. The load circuit 660 within the load element 640 is functional at both UHF and in the desired LF or HF band. In this manner the FIG. 8 embodiment provides a dual band antenna function for UHF and LF or HF.

In the embodiment of FIG. 8 the UHF antenna function is provided similarly as in the above listed embodiments through the first arm 610, load element 640, and second arm 620 structural components.

The antenna of FIG. 9 is an embodiment providing tri-band operation within separate LF, HF, and UHF bands using separate load circuits for each band. The Faraday coil 711 is excited by the LF magnetic field in the LF frequency band of interest. The Faraday coil 721 is excited by a magnetic field in the HF field of interest. The load element contains the UHF element 742, a resonating capacitor 746 for the LF band, and a separate resonating capacitor 743 for the HF band to enhance the RF voltage levels presented to the respective load circuits 761 and 725. The UHF antenna function is obtained from the coupling of the first and second arms together into the load element 740 and with a further coupling of the UHF signal into the UHF load circuit 760.

FIG. 10 describes an embodiment for dual band operation in a selected UHF band and either an LF or HF band making use of a separate load circuit for each band. The Faraday coil 811 and its separate resonating capacitor 846 together form a tank circuit for the LF or HF band of interest. The Faraday voltage from the LC tank circuit is connected directly into LF/HF load circuit 861. The UHF antenna function with load circuit 860 is obtained from the electromagnetic coupling between the structure of first arm 810, the load element 840, and the second arm 820 as in the other embodiments of this invention. The load element 842 contains the UHF matching network and separate load circuits for UHF and either the selected LF or HF bands. The antenna of FIG. 10 provides dual band performance including the UHF and either an LF or HF band.

FIG. 11 is a schematic of an embodiment comprised of a multilayer LF Faraday coil in which the coil 910 wraps around a dielectric. The continuous wrap around coil 910 provides electrical continuity around the dielectric and between contacts A and D for the LF operation of the antenna. The two ends of the wrapped coil are connected into the load element between contacts A and D. An LF load circuit and its resonating capacitor and other selected components are connected between C and D 980. A UHF load circuit 940 is connected within the load element between terminals A and B. The antenna is asymmetrical along its axis as in the above described embodiments with similar impedance matching structures and parameters. This antenna is a dual band antenna LF and UHF.

FIG. 12 is a schematic a dual band antenna with a multilayer coil 910 wrapped around a dielectric 920 with asymmetry along the main axis. In this embodiment a single load circuit 945 operates at both LF and UHF providing a dual band antenna.

FIGS. 13 and 14 show performance of the antenna in the 860 to 960 MHz range from a representative UHF structure. The physical length of antenna along the major axis is 54 mm and the width is 30 mm. The Faraday coils are single level on a flexible dielectric film. The load element is comprised of a T-match network designed to match the complex impedance of the asymmetrical first and second arms into the UHF load circuit. The load circuit has an equivalent capacitance values selected in the range 1.05 to 1.25 pF. The parallel equivalent resistance of the load circuit is 1560 Ohms. FIG. 13 is an plot of the power reflected back into the load element at the first port with the load circuit connected as a function of UHF frequency and is commonly known as the S11 parameter. The reflected power minimum in this case is less than −15 dB with three selected load circuit capacitance values 1.05, 1.15, and 1.25 pF at the selected UHF frequency bands of interest. FIG. 14 shows the radiation pattern at 915 MHz in the yz plane as omnidirectional and in the xy plane with a null in the direction of the major x-axis. The antenna structure lies in the xy plane. The maximum gain of the antenna at UHF is 2.23 dBi.

FIGS. 15 describes an embodiment comprised of a thermoelectric transducer. The first arm serves as a cooling fin and the second arm is thermally connected to a hot substrate. The resulting temperature differential between the two arms is thermally conducted across a thermoelectric transducer contained within the load circuit. The thermoelectric transducer presents a relatively high impedance into the load element and permits other parallel load circuits such as transponders and energy scavengers to operate efficiently. A thermoelectric transducer with a high impedance can be better matched to the load circuit and parallel-connected load circuits. This transducer is obtained using an array of semiconductor couples of alternating P and N polarity. The semiconductor couples are arranged in series-parallel combinations to obtain a desired transducer impedance over the UHF frequency band selected for this antenna.

FIG. 15(*a*) is a top view of the antenna structure with a thermoelectric transducer 1061 connected with other load circuits 1062,1063. The load element 1040 contains the UHF impedance matching network 1040 connected between the cold first arm 1010 and the hot second arm 1020. Thermally conductive fingers 1064 from the first 1010 and second arm 1020 extend into the load element to make thermal and electrical contact with the thermoelectric transducer. In this case the first arm has cooling fins 1022 integral to the conducting surface. FIG. 15(*b*) is a side view of the antenna of FIG. 15(*a*) and shows the cooling fins 2011 thermally connected to the surface 1021 of the first arm. A thermal insulator 1011 such as a foam material provides the desired thermal insulation between the cold surface 1010 and an external substrate. The second arm 1020 is thermally connected to an underlying hot substrate. A thermally conducting layer 1090 of film, adhesive, or binder is used to complete the UHF antenna. FIG. 15(*b*) is side view cross section showing the thermoelectric transducer 1061 with a die bond 1066 onto a conducting strap 1067 with the entirety bonded onto the thermally conductive fingers 1064. FIG. 15 (*d*) is a schematic of an array of semiconductor P-N materials in a series connection comprising a thermocouple voltage source within the transducer 1061. The cold finger of the first arm 1071 and the hot finger of the second arm 1072 provide the thermal connection and temperature different into the transducer necessary for thermocouple action. A thermoelectric transducer of this type is typically called a thermopile.

This example presents the UHF antenna function only. Structures for extending the antenna operation to LF and HF bands will be readily derived from other embodiments presented in this disclosure by those skilled and knowledgeable in the art.

A preferred method of making the antenna is to first form a patterned metallization onto both sides of a dielectric substrate. Vias as desired are next formed through the substrate with the interconnects for the LF and HF coils. Discrete components including one or more integrated circuits are positioned and bonded to the first patterned substrate. The selected discrete components capacitors, integrated circuit packages, and sensors are bonded to the dielectric substrate, generally on the topside. The discrete components may or may not have stiffening straps depending on the need for flexibility of the dielectric substrate. Bonding is accomplished using standard pick and place assembly using ultrasonic scrub, high temperature soldering, or conductive epoxy wherein the device is mounted as a direct conductive connection into a specified position. The antenna may be sealed in a protective case of appropriate materials.

While various embodiments of the present invention have been described above, it should be understood that they have been presented by way of example only, and are not limited as such. It will be apparent to persons skilled in the relevant art that various changes in the embodiments described are within the claims.

What is claimed is:

1. A multiband antenna comprised of three structures:

a first arm, a load element, and a second arm which are positioned along a defined major axis;

wherein the first arm and the second arm are located at the extremities of the major axis and are each separately connected through a first and second port to respective ends of the load element;

wherein the load element is positioned off-center along the major axis and the antenna does not have symmetry when folded about the midpoint of the major axis;

wherein the load element contains one or more load circuits;

wherein the load element is comprised of a network matching the complex impedance presented by physical connections from the ports to the corresponding complex conjugate impedance of the load circuits;

wherein the load element does not present a purely resistive impedance into either the first or second port or combinations thereof at any of the operational frequencies of the antenna;

wherein one or both arms each are comprised of one or more Faraday coils operating at one or more low and high frequency bands with signal connections into the load circuit or load circuits; and wherein a coupling of RF currents and electromagnetic fields within and near the surface of the three structures provides an antenna function for a first UHF frequency band.

2. The antenna of claim 1 configured with fully passive, semipassive, or active load circuits for use as an RFID tag comprised of one or more transponders, and RF energy scavengers with application selected from the group consisting of a credit card, animal eartag, bracelet, necklace, hat, environmental sensor, location sensor, tracking and identification, and display functions and structures.

3. The antenna of claim 1 wherein the structure provides one or more of functions for scavenging power from incident RF fields, receiving wireless data from incident RF fields, transmitting RF signal power, providing backscatter modulation of the incident RF fields; and transducer functions selected from the group consisting of measurement of temperature, humidity, vibration, fluid flow, corrosion, pressure, presence of gas or chemicals, power consumption, light, flames, and display of information.

4. The antenna of claim 1 wherein one or more of the arms contain Faraday coils directly connected to one or both ports of the load element.

5. The antenna of claim 1 wherein one or more Faraday coils wrap around both ends of the major axis to provide low frequency LF or high frequency HF operation.

6. The antenna of claim 1 configured with one or more Faraday coils structured in a series connection and on multiple stacked parallel planes.

7. The antenna of claim 1 with a Faraday coil with a first LF operational frequency band additionally structured with a bypass capacitor of sufficiently small reactance to effectively reduce the coil inductance at a higher frequency thereby providing for operation at both a LF and a HF frequency band.

8. The antenna of claim 1 structured with a thermoelectric power source within the load circuit wherein the first and second arms are maintained at different temperatures and structured with a thermal path to provide a differential temperature to the thermoelectric power source.

9. The antenna of claim 1 with dielectric substrate films selected from the group consisting of polyethelene terephthalate PET, polycarbonate, polybutylene terephthalate PBT, Duroid, polyphenylene sulfide PPS, polysulfone, polyetherimide, polyester sulfone PES, polyimide, polyester aramid polyamideimide PAI, nylon, Teflon, polyetherimide, polyvinylchloride, acrylonitrile butadiene styrene ABS, glass and other materials including paper.

10. The antenna of claim 1 comprised of conductive films selected from the group consisting of aluminum, copper, silver, gold, and nanotubes patterned by means selected from the group consisting of but not limited to lithography etching, inkjet printing, selective electroplating, stamping, laser ablation, and focused ion beam deposition.

11. The antenna of claim 1 positioned above a parallel conducting plane made out of a material selected from the group consisting of aluminum, iron, brass, and steel to provide a reflector at ultra high frequency and higher frequencies with gain in the forward direction away from the conducting plane.

12. A method for forming the antenna of claim 1 with primary operations for (i) forming a first patterned metallization comprised of a first arm, a load element, and a second arm onto one or more dielectric substrates;

(ii) forming a second patterned metallization with vias through a first dielectric substrate to provide an interconnection within a Faraday coil or coils as needed;

(iii) positioning and bonding onto one or more patterned metallizations one or more integrated circuits and electronic components to comprise the load circuit within the load element; and (iv) fixing the antenna into a specified position within and sealing in a protective case.

* * * * *